United States Patent [19]

Sammon

[11] Patent Number: 5,001,735

[45] Date of Patent: Mar. 19, 1991

[54] X-RAY DOSE COMPENSATION FOR RADIOGRAPHIC APPARATUS WITH KV RIPPLE

[75] Inventor: Robert J. Sammon, Seven Hills, Ohio

[73] Assignee: Picker International, Inc., Highland Hts., Ohio

[21] Appl. No.: 387,356

[22] Filed: Jul. 31, 1989

[51] Int. Cl.[5] ..... H05G 1/34

[52] U.S. Cl. ..... 378/96; 378/97; 378/108; 378/110

[58] Field of Search ..... 378/96, 97, 101, 108, 378/109–112

[56] References Cited

U.S. PATENT DOCUMENTS 4,311,913 1/1982 Resnick et al. ..... 378/110

4,796,286 1/1989 Ochmann et al. ..... 378/110

*Primary Examiner*—Carolyn E. Fields

*Assistant Examiner*—David P. Porta

*Attorney, Agent, or Firm*—Fay, Sharpe, Beall, Fagan, Minnich & McKee

[57] ABSTRACT

An x-ray tube (A) is powered by a control circuit (C) for selectively irradiating a sheet of x-ray film (B). An operator selects the operating anode current mA for the x-ray tube, an exposure or dose value (preferably an mAs value), and a tube voltage kV on a keyboard (20). For a fixed operating voltage and selected mAs value, the film should be exposed to the same density regardless of whether a low mA and a long time or a high mA and a short time are selected. Particularly in single phase inverter control circuit and power supplies, the high current and short time exposure tend to be underdeveloped relative to low mA and long time exposures for the same mAs value. To standardize the exposure for any current and time combination of the selected mAs value, a look up table (60) is provided. The look up table is addressed by the selected kV, mA, and mAs values to retrieve an appropriate current boost value which boosts the actual current such that the film is exposed to the selected density. The current boost value is added (42) to the selected current such that the x-ray tube is operated or boosted above the selected anode current by the appropriate amount for the x-ray film to be exposed to the same density for all mA and time combinations corresponding to the same mAs value. Alternately, exposure time may be lengthened to achieve the correct dose.

15 Claims, 2 Drawing Sheets

X-RAY DOSE COMPENSATION FOR RADIOGRAPHIC APPARATUS WITH KV RIPPLE

BACKGROUND OF THE INVENTION

The present invention relates to the radiography arts. It finds particular application in conjunction with switch mode, or inverter x-ray generators and will be described with particular reference thereto. However, it is to be appreciated that the invention will also find applicability in radiographic and other analogous systems with significant ripple.

A shadowgraphic x-ray system commonly includes an x-ray generating tube which projects radiation through a patient receiving region to a sheet of x-ray film or other radiation detecting medium. The x-ray tube includes a power supply which provides a voltage across anode and cathode of the x-ray tube in kilovolts (kV) and a filament current. The tube anode current (mA) is controlled by the filament current. Both the tube voltage or kV and the anode current or mA are selectively adjustable. A timer times the selectable duration of each exposure, normally measured in seconds (s).

The contrast of the x-ray film image is controlled primarily by the kV peak. The density of the exposed film is determined by the x-ray dose or exposure which is commonly designated by the product of the anode current mA and times. This product is commonly denoted as the mAs value. I n operation, the operator commonly sets the kV value such that the resultant image has a selected contrast. In a full manual operation, the operator commonly sets either the mAs value, or the anode current, and the exposure time in order to expose the film to a desired film density. In theory, the resultant film density, for a given kV value, should be the same for a selected mAs value regardless of whether a longer exposure time and a lower anode current or shorter exposure time and a higher anode current are selected.

In conventional three phase radiographic equipment, especially those having twelve pulse rectification of the output voltage, the film density varies little, if at all, with exposure mA for the selected mAs value. However, in radiographic equipment with less than twelve pulse rectification, which includes conventional three phase six pulse equipment, conventional single phase two pulse equipment, and switchmode or inverter generators, the film density or x-ray dose is typically not uniform over the range of times and anode currents Shorter duration, higher current exposures tend to have a lower overall dose, hence, a lower film density relative to the images taken with a lower anode current, hence longer duration exposure.

It should be noted that one reason for the reduced dose at higher anode currents in radiographic equipment with less than twelve pulse rectification is that the kV ripple generally increases at higher tube currents for such equipment. While the correct kV peak value, hence the correct image contrast, is achieved at both low and high anode current, the density of images of the same mAs will be lower at higher anode current settings due in part to the higher kV ripple.

In an auto exposure mode, the operator typically sets the desired contrast, or kV value and selects the tube current. The control circuit then integrates the dose of radiation actually received by a portion of the film. When the dose corresponding to the desired film density is reached, the automatic exposure control terminates the exposure. Although the automatic exposure mode produces images of the selected density, at higher tube currents the exposure time is longer than predicted.

SUMMARY OF THE INVENTION

The applicant herein has determined that this kV ripple also causes a reduction in the dosage for a given mAs setting, which dose reduction changes with an anode current. Specifically, the dose reduction increases with an anode current, causing a reduction of up to 10% of the selected dose, and a resulting reduction in image density at higher currents.

In accordance with one aspect of the present invention, the variation in dose for each of a plurality of kV, mAs, and anode current settings is determined and stored. When the operator selects a desired kV, mAs, or anode current and exposure duration, the actual anode current is boosted over the selected anode current in accordance with the stored variations. Alternately, the actual exposure time can be increased over the selected exposure time in accordance with the stored variations.

In accordance with another aspect of the present invention, a radiographic apparatus is provided. The apparatus includes appropriate operator controlled selection means by which the operator selects the kV and mAs, or anode current and exposure durations. An anode current correction means determines an appropriate correction to the selected anode current in accordance with the operator selected values. A tube power supply supplies the selected kV to the x-ray tube and a filament current that is boosted in accordance with the correction from the anode current correction means.

One advantage of the present invention is that it corrects diagnostic image degradation attributable to kV ripple, and other factors.

Another advantage of the present invention is that it provides dose consistency between radiographic equipment with single phase and three phase power supplies.

Another advantage of the present invention is that it improves film density consistency.

Still further advantages of the present invention will become apparent to those of ordinary skill in the art upon reading and understanding the following detailed description.

BRIEF DESCRIPTION OF THE DRAWINGS

The invention may take form in various components and arrangements of components and in various steps and arrangements of steps. The drawings are only for purposes of illustrating a preferred embodiment and are not to be construed as limiting the invention.

DETAILED DESCRIPTION OF THE PREFERRED EMBODIMENT

Figure 1:
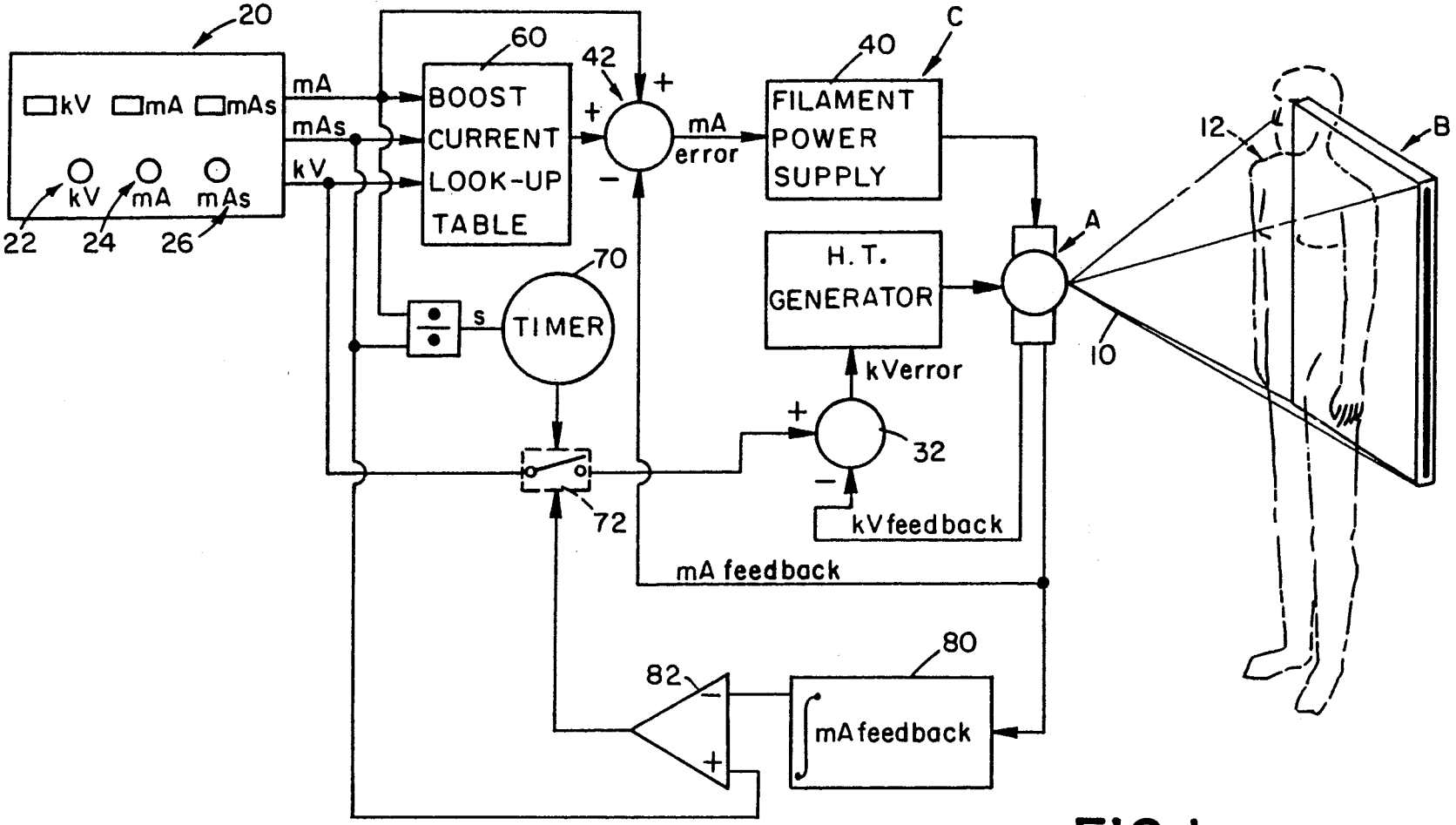
FIG. 1 is a diagrammatic illustration of a shadowgraphic x-ray system in accordance with the present invention.

With reference to FIG. 1, an x-ray tube A selectively transmits a swatch of radiation 10 through a subject receiving region 12 to an x-ray detection means B. Preferably, the x-ray detection means is an x-ray permeable, light impermeable film canister in which sheets of x-ray sensitive film are selectively mounted An x-ray tube control circuit C controls an operating voltage or kV across the anode and cathode, an anode current or mA, and an actuation duration of the x-ray tube A. Anode current or mA is regulated by means of adjustment to the filament current.

The x-ray tube control C includes a panel 20 which has a voltage select means 22 for selecting the tube voltage or kV, a current select means 24 for selection of the anode operating current or mA, and a dose select means 26 for selecting the dose or mAs value. Because the mAs value is the product of the anode current and the exposure duration, the operator can select any two of the anode current, the mAs value, and exposure duration. Most commonly, the operator selects the anode current and mAs value.

A high voltage or high tension generator means 30 generates the selected tube voltage and applies the kV across the cathode and anode of the x-ray tube A. Typically, a kV sensing means senses the actual voltage applied across the tube and sends back a corresponding kV feedback signal. A kV error detection means such as a summing node 32 compares the selected and actual voltage values and sends an error adjustment signal to the high voltage generator 30.

Analogously, a current power supply 40 controls the filament current. An actual current sensing means generates an mA feedback signal indicative of the actual anode current. A comparing means, such as an mA signal summing node 42 compares the actual current with the selected current and produces a corresponding mA error signal. The mA error signal causes the filament power supply 40 to be adjusted, up or down, until the selected and actual anode current is brought into conformity.

Figure 2:
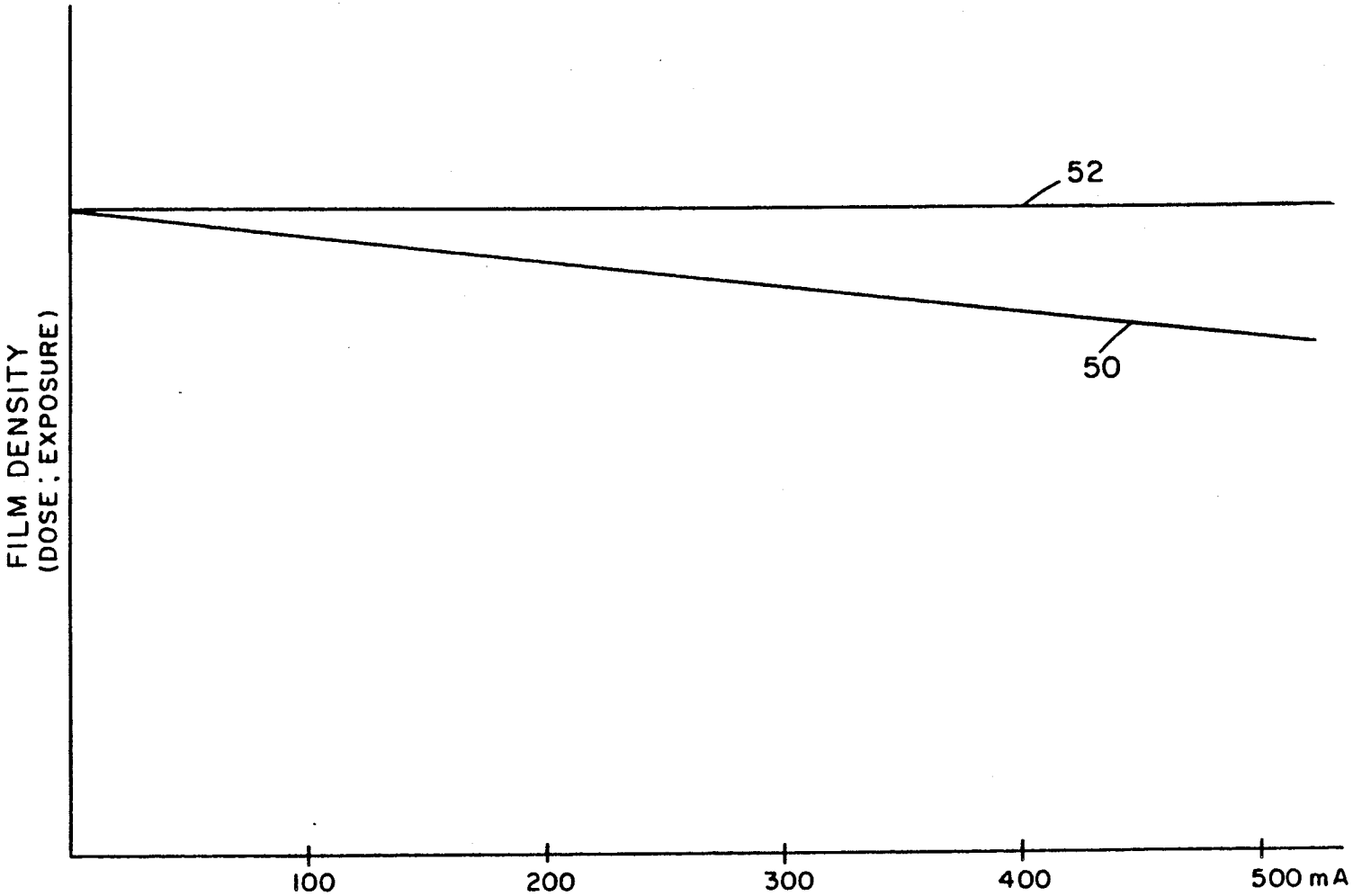
FIG. 2 is an exemplary plot of exposure dose vs. anode current in mA at constant kV and mAs values.

With reference to FIG. 2, the dose or exposure theoretically should be constant for a given mAs value. That is, a dose of 50 mA and 1.0 seconds should expose the film to the same density as the dose at 500 mA at 0.1 seconds. However, the film density or dosage varies with the tube current even for a selected kV and mAs setting. The greater the ripple, the greater the variation in dose with filament current. In the example of FIG. 2, the actual dose or resultant film density to are lower than a theoretical or three phase twelve pulse actual dose or film density 52. With a significant ripple and a higher mA, the actual dose or film density 50 falls below the three phase twelve pulse power supply dose 52. However, the contrast stays the same because that is determined by the kV peak value. If the ripple increases, the slope of curve so becomes greater; and, if the ripple decreases, curve 50 approaches curve 52. In the example of FIG. 2, the exposure dose for a 100 mA anode current is about 5% less than the dose for a 20 mA anode current, the kV and mAs values being held constant. Similarly, at each higher anode current, the film density drops off.

With reference again to FIG. 1, a dosage or film density correction means 60 boosts the selected mA value by the amount necessary to shift the selected mA curve 50 for the selected operating mA up to the level of the three phase twelve pulse power supply curve 52. To shift the 100 mA up to the exposure dose level of the mA curve 52, about a 5% boost in the tube current is required. Similarly, shifting the 200 mA to the curve 52 requires boosting the tube current by about 10%. Shifting the 500 mA to the curve 52 calls for about a 20% boost to the selected mA. The exact amount by which the anode current is boosted varies with the actual hardware including the amount of ripple, the selected mAs, the selected kV value, and other operating parameters. In the preferred embodiment, the dosage or film density correction means 60 is embodied in a look up table that is preprogrammed in accordance with the actual hardware in which it is installed. The look-up table is addressed by the selected mA value, the selected mAs value, the selected kV value, and the like. The look up table retrieves an appropriate anode current boost, previously determined by trial and error, trial and error and extrapolation, or the like. The anode current boost is added to the selected anode current at the summing junction 42.

Optionally, other dose or density correcting means may be utilized. For example, a feedback amplifier circuit may be provided which amplifies the selected anode current by an adjustable percentage or an adjustable percentage plus an offset. The amplifiers may be appropriately biased or their gain selected in accordance with the selected mAs, kV, and other above discussed values such that the selected anode current is corrected or adjusted in order to bring the film density into a preselected degree of correspondence with the film density that would have been attained in a three phase twelve pulse x-ray generator.

Timing means 70 opens a switch means 72 at the end of a selected exposure duration which causes the voltage power supply means 32 to terminate the supply of power to the x-ray tube. The timing means 7 may be set directly by the operator or may be determined by dividing the selected mAs value by the selected mA value.

The exposure may also be done on an mAs basis. An integrator means so which integrates the actual tube current. The output of the integrator or sum is the actual mAs value since the beginning of the exposure. An mAs comparing means 82 compares the integrated mAs value with the selected mAs value and opens the switch 72 when the selected mAs value has been attained.

The invention has been described with reference to the preferred embodiments. Obviously, modifications and alterations will occur to others upon reading and understanding the preceding detailed description. It is intended that the invention be construed as including all such alterations and modifications insofar as they come within the scope of the appended claims or the equivalents thereof.

Having thus described the preferred embodiment, the invention is now claimed to be:

1. A radiographic apparatus comprising:

an x-ray tube for selectively generating a beam of radiation which is directed through a subject receiving area and impinges on a radiation detecting means;

a control circuit for operating the x-ray tube with a selectable anode current and tube voltage;

an operator input means for an operator to designate at least a selected anode current and a dose, the operator means being operatively connected with the control circuit for causing the control circuit to operate the x-ray tube at the selected current for a duraction theoretically projected to irradiate the subject receiving area with the selected dose;

a boost current determining means for determining a boost current from the designated current and dose;

a current adjusting means for selectively adjusting the designated current in accordance with the determined boost current.

2. A radiographic apparatus comprising:

an x-ray tube for selectively generating a beam of radiation which is directed through a subject receiving area and impinges on a radiation detecting means;

a control circuit for operating the x-ray tube with a selectable anode current and tube voltage;

an operator input means for an operator to designate at least a selected anode current and a dose, the operator means being operatively connected with the control circuit for causing the control circuit to operate the x-ray tube at the selected current for a duration theoretically projected to indicate the subject receiving area with the selected dose;

a look up table means which is addressed at least by the designated current and dose and which retrieves a current boost in accordance therewith;

a current adjusting means for selectively adjusting the designated current, in accordance with the retrieved current boost.

3. The apparatus as set forth in claim 2 further including a summing means for summing the designated current with the current boost from the look up table.

4. The apparatus as set forth in claim 3 further including:

a current feedback means for feeding back to the summing means a feedback signal which is a negative of the actual anode current produced in the x-ray tube such that the summing means produces a current error signal; and, a current power supply which receives the current error signal and controls the anode current such that the current error signal is minimized.

5. The apparatus as set forth in claim 1 wherein the operator input means also includes means for the operator to designate an operating voltage for the x-ray tube and the control circuit further includes a high tension generator means for supplying the x-ray tube with the designated x-ray tube voltage.

6. The apparatus as set forth in claim 5 wherein the current adjusting means includes a look up table which is preprogrammed with current boost values in accordance with selected current, designated dose, and selected tube voltage, the look up table means being operatively connected with the operator means to receive the selected current, dose, and tube voltage therefrom.

7. The apparatus as set forth in claim 1 further including a timing means controlled by the designated dose for causing the control circuit to terminate the supply of power to the x-ray tube after a time corresponding to the designated dose.

8. The apparatus as set forth in claim 1 wherein the radiation detecting means includes a sheet of photographic film.

9. The apparatus as set forth in claim 8 further including a timing means controlled by the designated dose for causing the control circuit to terminate the supply of power to the x-ray tube after a time corresponding to the designated dose.

10. The apparatus as set forth in claim 9 wherein the dose designated by the operator corresponds to a desired film exposure density and the current adjusting means adjusts the designated current such that the film is exposed to the desired density in the time controlled by the timing means.

11. A method of radiographically producing images, the method comprising:

selecting at least an x-ray tube current and exposure time combination;

determining an adjustment value from the selected current and exposure time combination;

adjusting the selected x-ray tube current and exposure time combination in accordance with the determined adjustment value;

causing an x-ray tube to operate with the adjusted current and exposure time combination;

directing x-rays emitted by the x-ray tube through a subject receiving area into contact with an x-ray detecting medium.

12. The method as set forth in claim 11 wherein the selecting step further includes selecting an x-ray tube operating voltage, the adjusting step includes adjusting the selected current and exposure time combination in accordance with the selected tube voltage, and the x-ray tube operating step includes operating the x-ray at the selected operating tube voltage.

13. A method of radiographically producing images, the method comprising:

selecting at least an x-ray tube current, an exposure value, and an x-ray tube operating voltage;

addressing a look-up table with the selected current, exposure value, and voltage, retrieving from the look-up table one of a plurality of previously stored current boost values and adding the current boost value to the selected current;

causing an x-ray tube to operate with the adjusted current at the selected voltage for a duration corresponding to the exposure value;

directing x-rays emitted by the x-ray tube through a subject receiving area into contact with an x-ray directing medium.

14. In a radiographic apparatus which exposes x-ray film with a selected contrast controlled by an anode-cathode voltage of an x-ray tube and to a selected density controlled by a combination of a selected anode current of the x-ray tube and a selected x-ray exposure time, but which film density is consistently lower than the selected density due to anode-cathode voltage ripple, the improvement comprising:

a means for boosting an actual anode current above the selected anode current such that the x-ray film is exposed to the selected density.

15. In a radiographic apparatus which exposes x-ray film with a selected contrast controlled by an anode-cathode voltage of an x-ray tube and to a selected density controlled by a combination of a selected anode current of the x-ray tube and a selected x-ray exposure time, but which film density is consistently lower than the selected density due to anode-cathode voltage ripple, the improvement comprising:

a means for determining an exposure time correction value from the selected anode current and the selected exposure time;

a means for boosting an actual exposure time to exceed the selected exposure time by the exposure time correction value such that the x-ray film is exposed to the correct density.

* * * * *